United States Patent [19]

Alota et al.

[11] Patent Number: 4,952,287

[45] Date of Patent: Aug. 28, 1990

[54] ELECTROLYTIC GALVANIZING PROCESSES

[75] Inventors: Santa Alota; Nazzareno Azzerri; Roberto Bruno; Massimo Memmi; Susanna Ramundo, all of Rome, Italy

[73] Assignee: Centaro Sviluppo Materiali S.P.A., Rome, Italy

[21] Appl. No.: 370,169

[22] Filed: Jun. 21, 1989

Related U.S. Application Data

[63] Continuation of Ser. No. 07/13/288, Dec. 9, 1987, abandoned, which is a continuation of Ser. No. 06/886,786, Jul. 18, 1986, abandoned.

[30] Foreign Application Priority Data

Jul. 18, 1985 [IT] Italy ..... 48371 A/85

[51] Int. Cl.[5] ..... C25D 7/06

[52] U.S. Cl. ..... 204/28

[58] Field of Search ..... 204/28

[56] References Cited

U.S. PATENT DOCUMENTS 3,816,082 6/1974 Austin et al. ..... 204/28 X 3,989,604 11/1976 Austin ..... 204/28

OTHER PUBLICATIONS

A. Weymeersch et al., Plating & Surface Finishing, pp. 118–120, May 1981.

A. Weymeersch et al., Plating and Surface Finishing, vol. 68, pp. 56–59, Apr. and pp. 118–120, May 1981.

*Primary Examiner*—G. L. Kaplan

*Attorney, Agent, or Firm*—Young & Thompson

[57] ABSTRACT

Electrolytic galvanizing process in which steel strip to be zinc coated is passed continuously through an acid electrolyte solution containing zinc ions and is used as a cathode, while the electrolyte solution is made to flow in the space between the cathode and the anode, in a cell having flat parallel electrodes. The plating current density and the fluid dynamic conditions of the electrolyte are related by the equation $$I = K\ C\ Re^{n}$$

in which I is 15–300 A/dm$^2$, K is 0.01–0.0001 A/dm$^2$ l/g, C is 40–80 grams of zinc per liter of electrolyte solution, Re is the Reynolds number between 1,000 and 200,000, and n is 0.55–0.85. Preferred values are K=0.001, C=80 g/l and n is 0.7.

1 Claim, 5 Drawing Sheets

ELECTROLYTIC GALVANIZING PROCESSES

Figure 1:
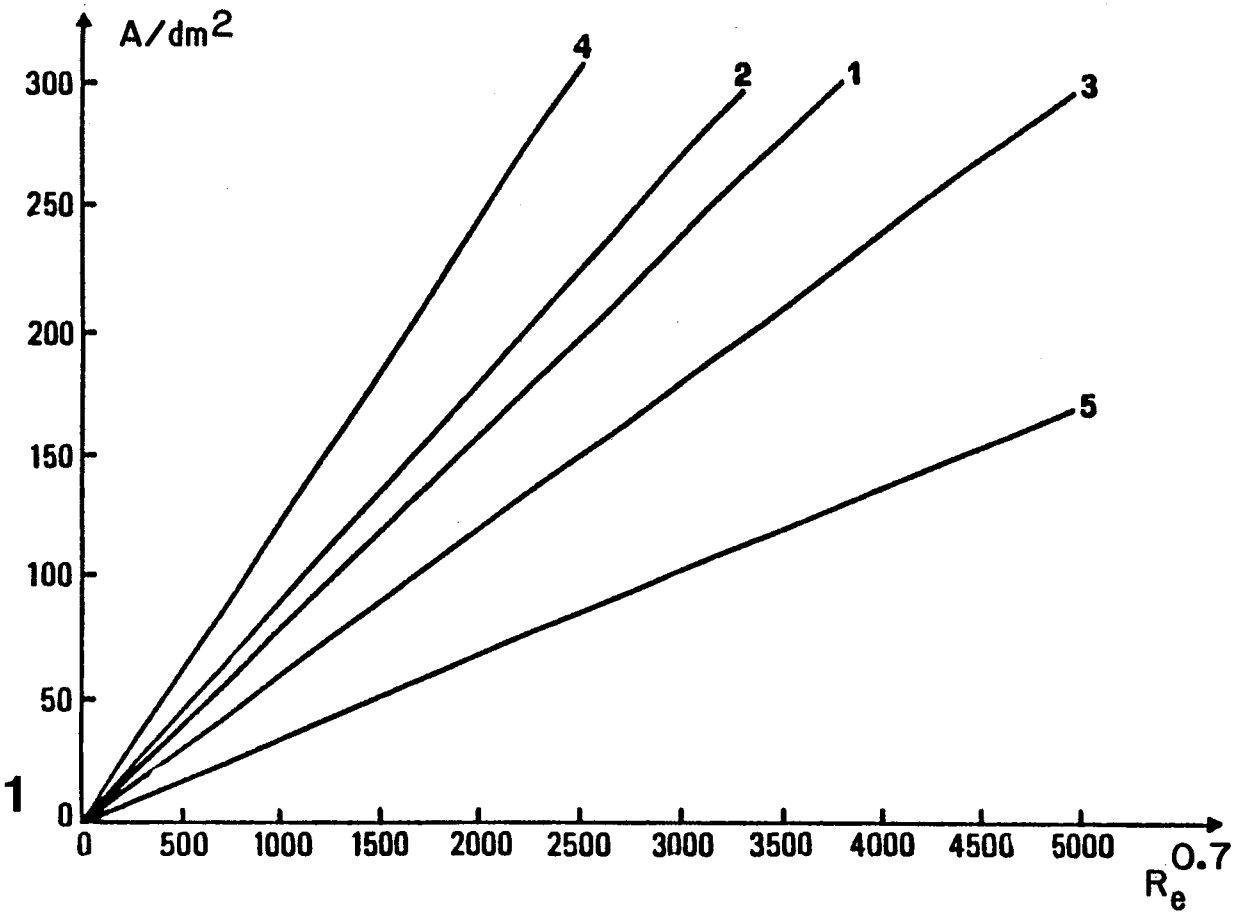

This application is a continuation of application Ser. No. 07/131,288 filed Dec. 9, 1987 which in turn was a continuation of application Ser. No. 06/886,786 filed July 18, 1986 and both now abandoned.

DESCRIPTION

This present invention relates to an improvement in electrolytic galvanizing processes. More precisely it relates to the definition of relations among process variables enabling very high quality deposits to be obtained.

Metal electroplating is, of course, a process in which a great number of variables, including temperature, bath composition and pH, current density, and plating cell geometry all play an important role in establishing galvanizing process yield and deposit quality.

With the growing interest in high current densities it has recently been recognized that the relation between strip movement and electrolyte flow in the cell, and especially the fluid dynamics conditions of the electrolyte are extremely important factors.

Notwithstanding recognition of this situation, however, industry is still not in possession of all the data needed to provide the market with consistently high quality products, particularly where high current density processes are concerned. Indeed, from the practical point of view commercial evidence indicates there still exist very wide quality variations not only between the high-current density electrogalvanized products of different producers but also within the range marketed by individual producers.

This state of affairs is confirmed by recent scientific studies. An article in "Plating and Surface Finishing", April 1981, pages 56 to 59, and May pages 118 to 120, concerns high-current density electrogalvanizing with soluble anodes in sulphuric acid baths. The effects on deposit morphology of current densities up to 300 A/dm$^2$ and electrolyte velocities of up to 4 m/s are reported. The authors identify five deposit morphologies distinguished by clearly marked and identifiable boundaries, as a function of current density and electrolyte velocity used.

Without going into detail the gist of the article can be summarized by saying that once given electrolyte velocity and current density limits are exceeded any value adopted for these parameters would permit deposits defined as "macroscopically uniform, smooth, and bright or glazed" to be obtained.

Though this information is apparently precise, it is really quite ambiguous. Indeed, while on the one hand it gives the impression that above certain current density and electrolyte velocity levels a uniform deposit should be obtained, other indications prompt the thought that in actual fact less satisfactory conditions are achieved.

Considering that in the illustrations accompanying the article, the zinc deposits consist of flat, variously-disposed, poly-oriented hexagonal crystals, the indication that the grains making up to 10 micrometers deposit have an average size of about 10 micrometers clearly shows that the thickness of the deposit must be quite variable and hence so must quality.

Finally, the morphology of the deposit apparently changes with thickness, ranging from poly-oriented plates in 10 micrometers deposits to poly-oriented hexagonal pyramids in deposits of 100 and 200 micrometers. The crystallographic orientation of the crystals, however, does not vary with coating thickness but only with plating current density, at least for values above 25 A/dm$^2$.

Taking these points as a whole it is quite evident that conditions for the electrogalvanizing process have still not been established with sufficient precision to ensure a high-quality, uniform, consistent product in every case.

In view of all this uncertainty, research has been pursued which has resulted in the present invention, the aim of which is to indicate—within known general framework of metal electroplating—the specific conditions that enable very high quality zinc coatings to be obtained consistently on steel, whatever the current density used. The research concerned coatings produced in the laboratory and on pilot and full-scale plants. The results concern the product, production procedures, and plants capable of ensuring correct embodiment of the procedures.

In the case of the process, the most important operating parameters have been ascertained, as have their inter-relations. It has been confirmed that current density, bath fluid dynamics and bath composition play a very important role, indeed, a decisive one as regards quality of the zinc deposit. It has also been found that the best way of establishing bath fluid dynamics is to adopt the Reynolds number which, of course, defines the turbulence of a fluid.

It has been possible to establish the following points which lie at the very basis of this invention:

There exists a relationship between current density and fluid dynamics condition in the plating cell, with bath composition comprising a curve slope correcting factor there are no discontinuities or changes in trend with this relationship on passing from laminar to turbulent electrolyte flow.

This invention is characterized by the fact that the relationship between current density usable in the zinc electroplating process and electrolyte fluid dynamics conditions can be expressed by the formula:

$$I = KC\,Re^{e}$$

where I is current density in A/dm$^2$, C is zinc concentration in the bath, in g/1, Re is the reynolds number characteristic of electrolyte flow in the cell, and K and n are empirical variables depending essentially on the geometry of the electrogalvanizing cell used. In the cells having flat, parallel electrodes used in the tests reported here, K and n have values of 0.001 and 0.7 respectively, the possible range of variation being $10^{-2}$ to $10^{-6}$ for K and 0.5 to 1 for n.

Within the limits of current density tested (up to 300 A/dm$^2$) the formula as per the invention furnishes the relation between selected current density and fluid dynamics conditions of the electrolyte in the cell necessary to obtain a zinc deposit formed of microcrystals all having a particular crystallographic orientation. In practice, this means that the (0001) face of the crystals is parallel to the surface of the material plated, the result being that the coating consists of hexagonal grains adjacent to one another thus forming a very compact, smooth, virtually continuous layer.

Along the line obtained by plotting I against Re$^n$, the size of the crystals obtained decreases as the plating current density increases.

The formula indicated above thus defines an infinite series of pairs of current-density/Reynolds-number values all of which ensure a product of very high quality. The situation does mot alter drastically even at a slight distance from a line on a graph of I against $Re^n$ obtained by plotting such pairs. However, it should be observed that around the line exists a zone where th morphology of the deposit changes evolving towards the formation of compact "rosettes" whose corrosion behaviour is still good. Outside this zone there are others with characteristic deposits the quality of which deteriorates gradually moving away from the ideal situation. All these zones have very well defined linear boundaries, indicated by formulae similar to that already given. The size of these zones is difficult to establish, but it can be said that with a given plating current density and Reynolds numbers higher than optimum, they are larger than with smaller Reynolds numbers.

Figure 2A:
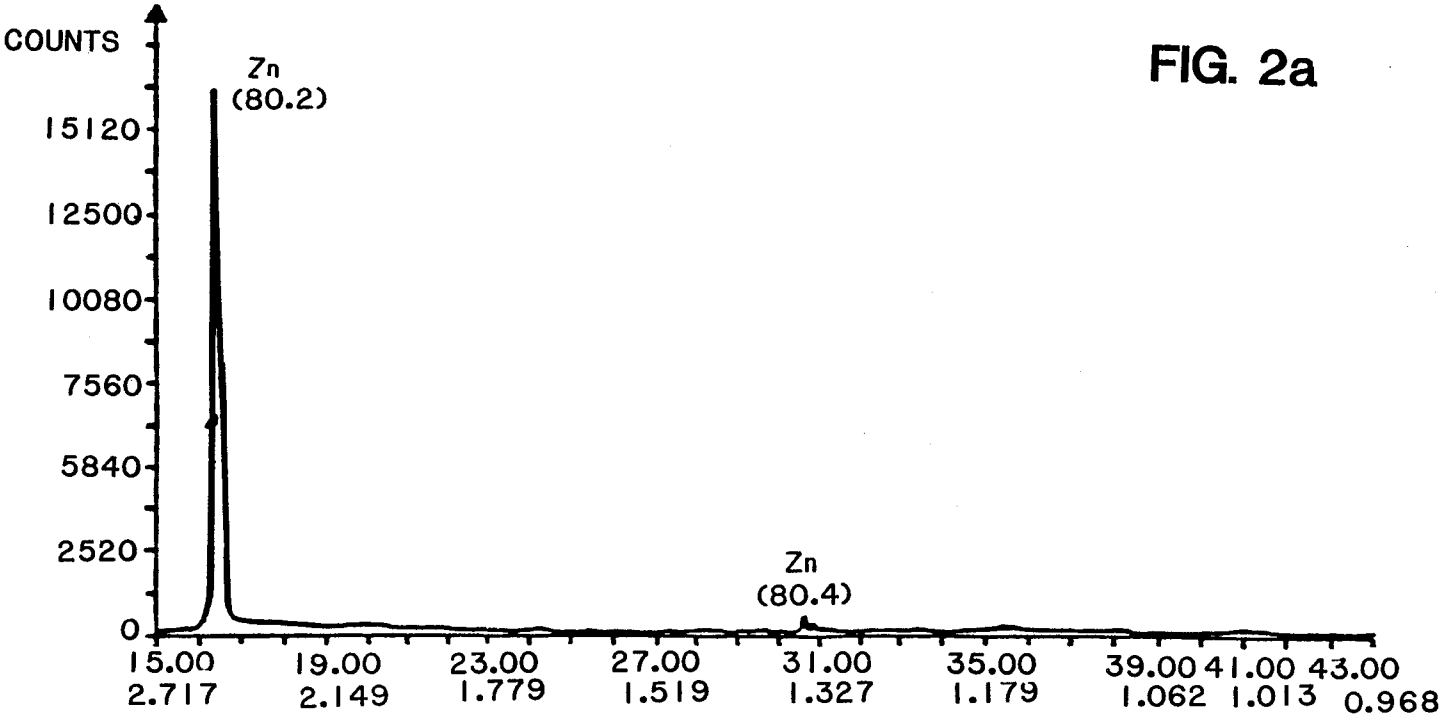
Figure 2B:
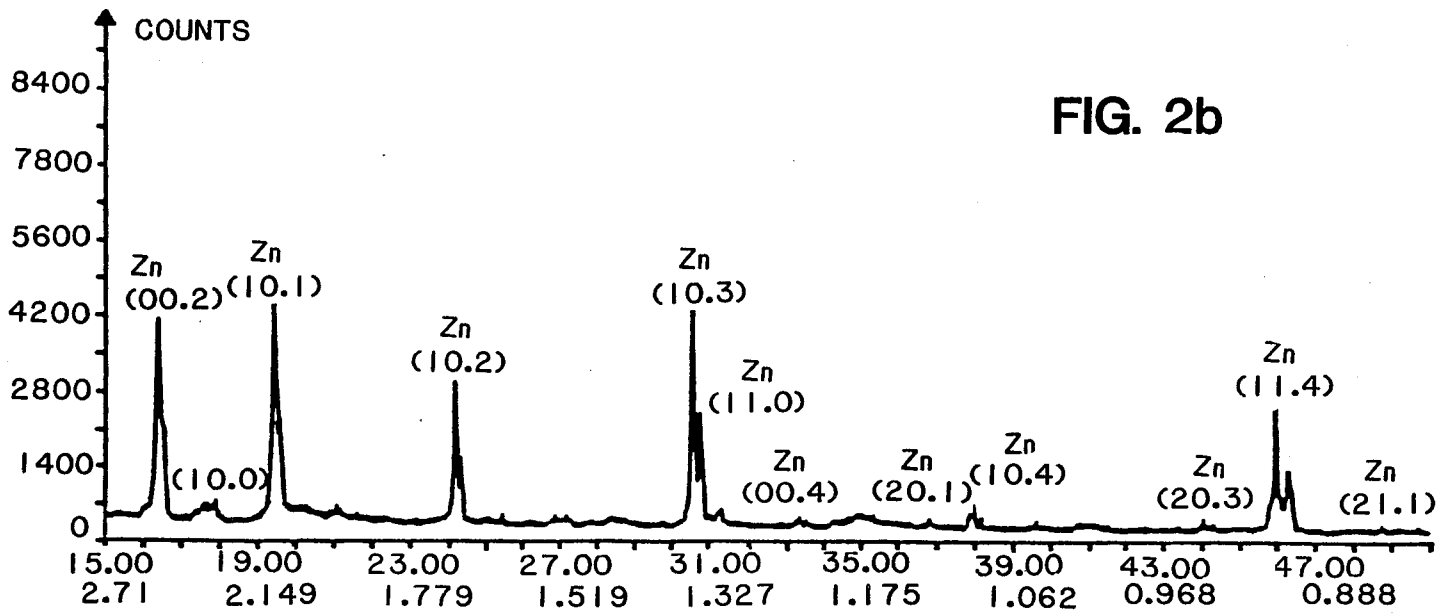
Figure 2C:
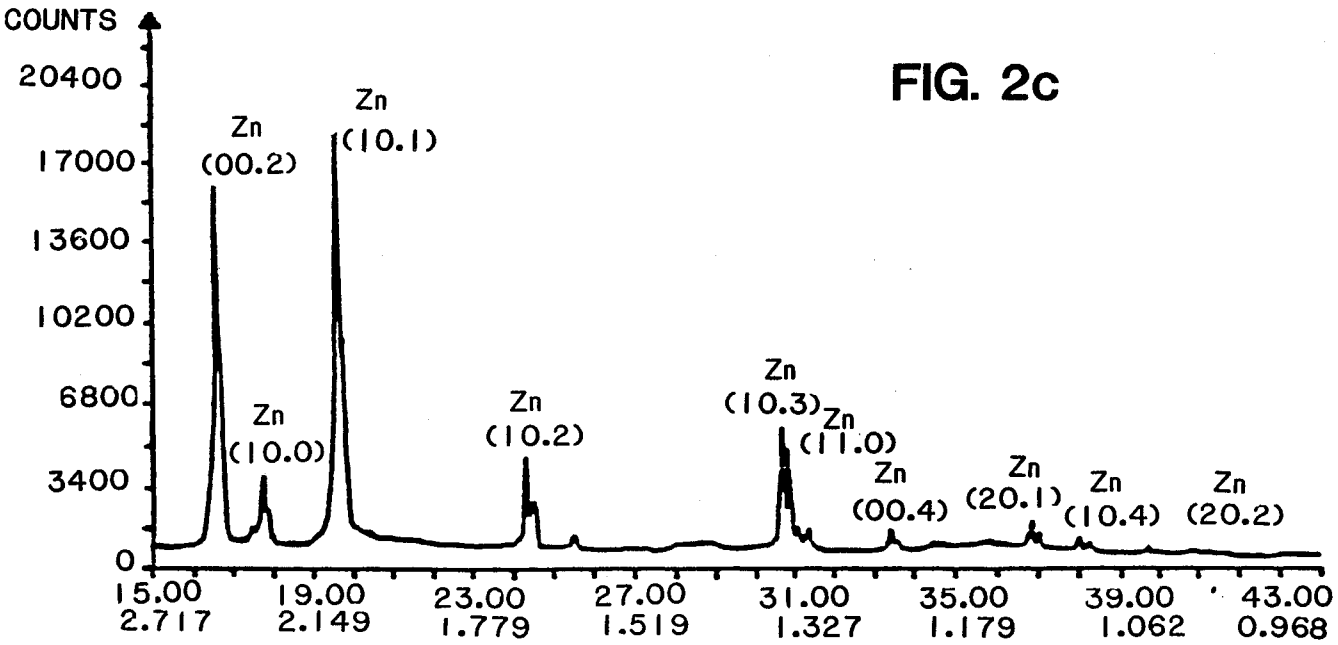
Figure 3:
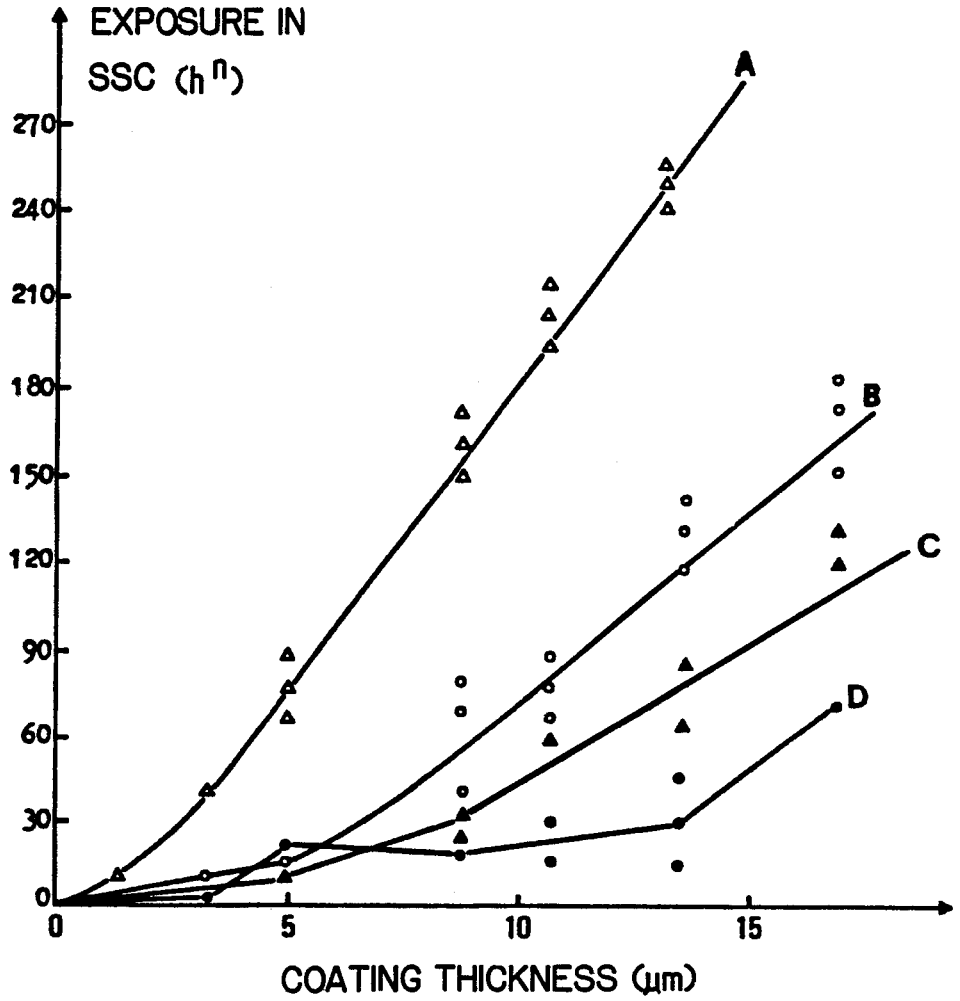

The present invention will now be explained in greater detail by reference to the accompanying Figures where:

FIG. 1 is a diagram illustrating the various types of zinc deposit that can be obtained by varying the electrogalvanizing conditions FIG. 2*a* is the typical X-ray diffraction spectrum of the zinc deposit as per this invention FIG. 2*b* and 2*c* are the X-ray diffraction spectra of other deposits not according to this invention FIG. 3 is the corrosion resistance curve of some types of zinc deposit, as a function of thickness.

Degreased, pickled 0.7 mm thick steel drawing strip was electrogalvanized in sulphuric acid baths at pH between 1 and 3.5, containing between 40 and 80 grams of zinc per liter. The galvanizing solution was made to flow in the galvanizing cells in such a way as to ensure Reynolds numbers between 1000 and about 200,000. The power supply was such as to ensure up to 300 $A/dm^2$.

Various temperatures between 45° and 70° C. were tried. Under the test conditions on marked temperature effects were encountered except on solution viscosity which, of course, helps modify the Reynolds number.

Test specimens obtained in the laboratory as well as on pilot and full-scale plants all gave results of the same kind; these were used to plot the FIG. 1 diagram where Curve 1 is defined exactly by the formula:

$$I=0.001C\ Re^{0.7}$$

in which the value of C is 80 g/1. The curve indicates the pairs of current-density/Reynolds-number values which always ensure a zinc deposit formed of crystals whose (0001) crystallographic plane is parallel to the strip surface. X-ray diffractograms of deposits obtained with any of the I/Reynold-number pairs as per the above formula give results like that illustrated in FIG. 2*a*, which shows clearly that all the crystals have the orientation just mentioned. Moving along Curve 1, relatively large crystals are obtained at low current density, average size decreasing with increase in $A/dm^2$. It can be said by way of indication that crystals averaging between 0.5 and 1.5 microns can be obtained with current density between 100 and 150 $A/dm^2$.

There are no morphological variations as coating thickness increases, at least in the range of thicknesses presently demanded by the market (2 to 15 micrometers).

Moving away from Curve 1, the morphology of the zinc deposit changes from what can be called mono-oriented microcrystalline (Curve 1) to compact crystalline, which occupies the regions between Curves 1 and 2 and 1 and 3. In these regions the dimensions of the deposited crystals increase and some loss of orientation starts to occur but the deposit is still of acceptable quality.

FIGS. 2*b* and 2*c* are the X-ray diffractograms of deposits obtained along Curves 3 and 2 respectively. These curves also mark the boundaries with regions wherein the morphology of the deposit changes even more and quality becomes quite unsatisfactory.

In the region between Curve 3 and Curve 5 the crystals forming the deposit are highly imbricated and the coating comes to have a typical needle-shaped appearance.

In the region between Curves 2 and 4 the deposit becomes coarsely dendritic with crystals that are pyramid shaped or of the multi-twinned hexagonal prism type. In the region beyond curve 4 the deposit takes on a blackish powdery appearance, while in that beyond Curve 5 coating is largely incomplete.

The completely unexpected feature that emerged from this work is that there exists a continuous relationship between current density and fluid dynamics conditions of the electrolyte in the cell. This relationship holds good from the very lowest to extremely high current densities, certainly well above those deemed to be of practical interest.

It will thus be possible to ensure optimum utilization of all plants merely by modifying the fluid dynamics conditions in the cell to suit the plating current density adopted.

The deposits obtained with this invention, consisting of extremely compact mono-oriented crystals, provide maximum corrosion resistance, as clearly demonstrated by FIG. 3 where Curve A represents the corrosion rate of deposits obtained using the pairs of current-density/-Reynolds-number values derived from Curve 1 in FIG. 1; Curve B represents the corrosion rate of deposits obtained with pairs of values between Curves 2 and 3 in FIG. 1; Curve C is for needle-shaped deposits obtained in the region between Curves 3 and 5; and Curve D is for dendritic deposits obtained in the region between Curves 2 and 4. It is readily apparent that much thinner coatings as per the present invention will withstand corrosion for the same time as thicker coatings not produced as per the invention or if the thickness is the same, then corrosion resistance time will be far greater.

The FIG. 3 curves concern various test campaigns made on specimens obtained in the laboratory as well as in pilot plant and full-scale test. It is interesting to note how the characteristics of products obtained in the laboratory or the pilot plant are very much in line with those of commercial products, even those found on the market, when produced as per the terms of this invention.

Curve D of FIG. 3 calls for special mention since the deposits involved are highly dendritic, so there are relatively few, large, highly ramified (multiple-twinned) crystals. Under these conditions the thickness of the deposit is extremely variable and irregular, so corrosion resistance is generally lower and it may happen that deposits of apparently greater thickness have lower corrosion resistance than does a deposit that is nominally thinner. Hence Curved D has no great physical meaning, since the corrosion behaviour of this type of deposit can really be represented only by a scattered set of experimental points.

The corrosion tests were run in the salt-spray chamber. However, this test is not standardized and may give apparently very diverse results depending essentially on the way the duration of the observation is established and on the manner of identifying the appearance of rust.

It is evident, therefore, that the salt-spray chamber test will not give results that are comparable with those obtained in other laboratories under different conditions, but it does provide a comparison of the performance of various products under the same conditions.

It should be noted, however, the Curve A, characteristic of the products as per the present invention indicates that in any case their corrosion resistance is superior to that of products obtained in other ways, and is certainly far in excess of the most stringent market requirement which, according to the latest specifications, call for corrosion resistance in the salt-spray chamber of 12 hours per micrometer of coating thickness.

The preferred range of K is 0.01 to 0.0001, the units of K being $A/dm^2$.

The preferred range of n is 0.55 to 0.85.

The preferred range of n is 0.55 to 0.85.

The preferred range of I is 15 to 300 $A/dm^2$.

We claim:

1. In an electrolytic galvanizing process in which steel strip to be zinc coated is passed continuously through an acid electrolyte solution containing zinc ions and is used as a cathode, while the electrolyte solution is made to flow in the space between the cathode and an anode in an electrolytic cell; the improvement comprising, in a given cell in which the range of current density (I) is 15–300 $A/dm^2$, the range of concentration (C) of zinc in the electrolyte solution is 40–80 g/1 and the range of Reynolds number (Re) is between 1,000 and 200,000, performing the following steps:

varying I, C and Re within the above ranges in said given cell until there is laid down on steel strip a deposit of zinc microcrystals in which the (0001) face of the crystals is parallel to the surface of the material plated, whereby the zinc coating consists of hexagonal grains adjacent to one another thus forming a very compact, smooth, virtually continuous layer;

changing the values of I, C and Re in said given cell within said ranges until another set of values of I, C and Re is found at which a zinc deposit formed of microcrystals as described above is formed;

inserting the two different sets of values of I, C and Re into the equation $I=K\ C\ Re^n$ and simultaneously solving the two equations thus produced to determine respective values of K and n; and subsequently operating said given cell to cast steel strip with zinc using still further different values of I, C and Re which satisfy the above equation when K and n have said determined respective values.

* * * * *

UNITED STATES PATENT AND TRADEMARK OFFICE

CERTIFICATE OF CORRECTION

PATENT NO. : 4,952,287

DATED : August 28, 1990

INVENTOR(S) : Santa ALOTA et al.

It is certified that error appears in the above—identified patent and that said Letters Patent is hereby corrected as shown below:

On the title page;

In Item "[73] Assignee:", change "Centaro" to --Centro--.

Signed and Sealed this

Fifth Day of November, 1991

*Attest:*

HARRY F. MANBECK, JR.

*Attesting Officer*

*Commissioner of Patents and Trademarks*